United States Patent [19]

Mulligan

[11] 3,994,416

[45] Nov. 30, 1976

[54] HINGED BOX

[75] Inventor: Robert J. Mulligan, Wheaton, Ill.

[73] Assignee: Richardson-Merrell Inc., Wilton, Conn.

[22] Filed: Oct. 27, 1970

[21] Appl. No.: 84,364

[52] U.S. Cl. ..... 220/338
[51] Int. Cl.² ..... B65D 51/04
[58] Field of Search ..... 220/31 S, 334, 337, 220/340

[56] References Cited

UNITED STATES PATENTS

| | | | |
|---|---|---|---|
| 2,287,903 | 6/1942 | Rathburn | 220/31 S |
| 2,347,981 | 5/1944 | Apfelbaum | 220/31 S |
| 3,179,281 | 4/1965 | Suoboda | 220/31 S |

*Primary Examiner*—George E. Lowrance
*Attorney, Agent, or Firm*—George W. Rauchfuss, Jr.; Eugene O. Retter

[57] ABSTRACT

A hinged box which has two hinges protruding from the back of the box, each hinge member composed of five ball elements which are interlocked. Two balls of each group of the five elements have grooves extending across opposite faces of the ball members, at least halfway but not entirely across, which provide pockets for the three other ball members whereby the five ball members are locked securely in a rotatable position to form a hinge. Each of the two parts of the box has at the back two ball elements on one side of the box and three at the other side of the back. A further improvement in the hinged box comprises longitudinal cylindrical bar-like members protruding from the back of each section of the box and resting in grooves on the other section of the box. This construction adds strength and stiffness to the hinge without impairing the smooth action of the hinge when opening and closing the lid on the box.

2 Claims, 9 Drawing Figures

FIG. 1
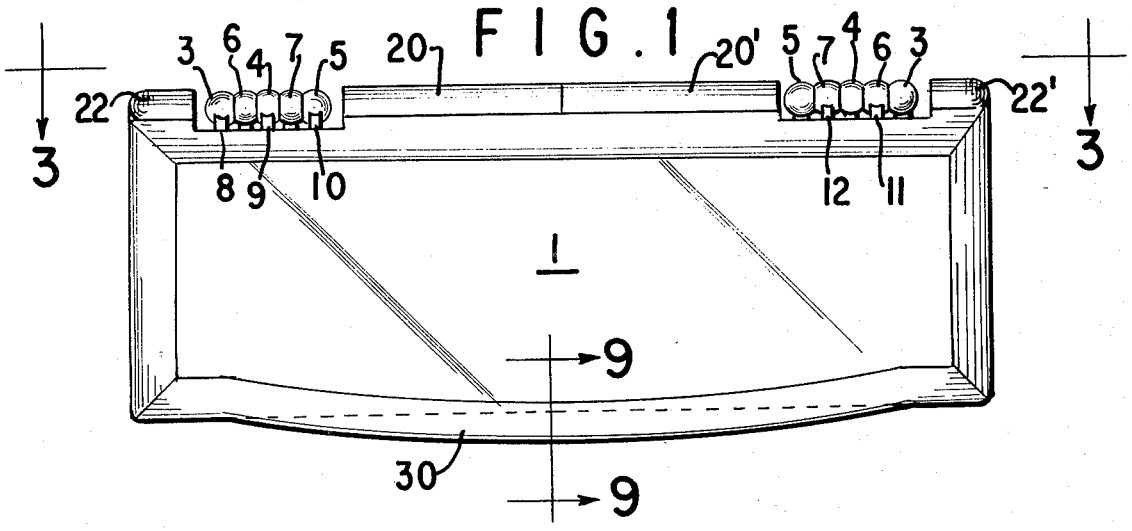
FIG. 2
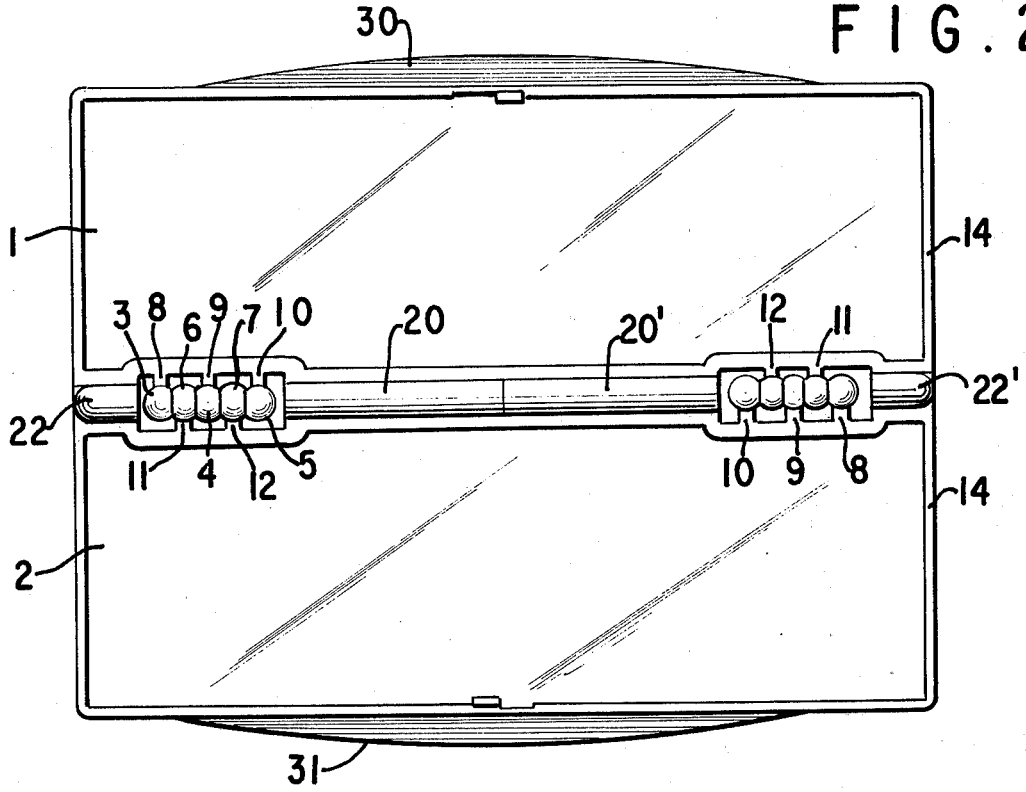
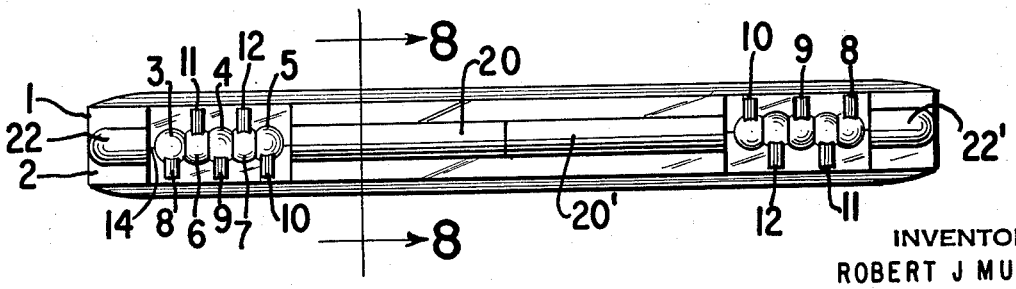
FIG. 3
INVENTOR
ROBERT J MULLIGAN
BY Harvey W. Stubblefield
ATTORNEY

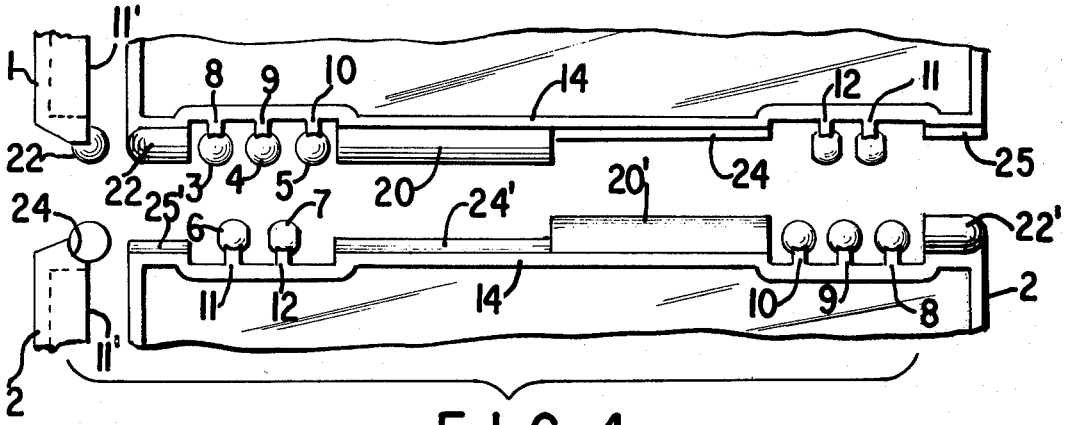
FIG. 4
FIG. 5
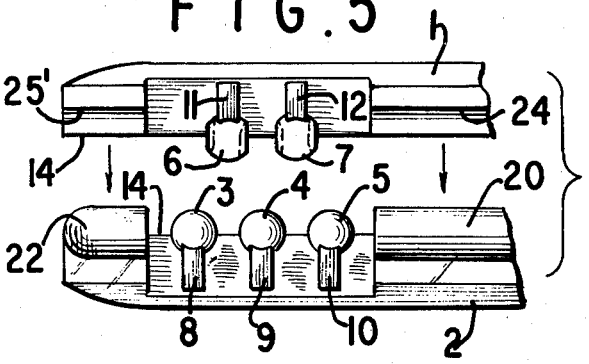
FIG. 6
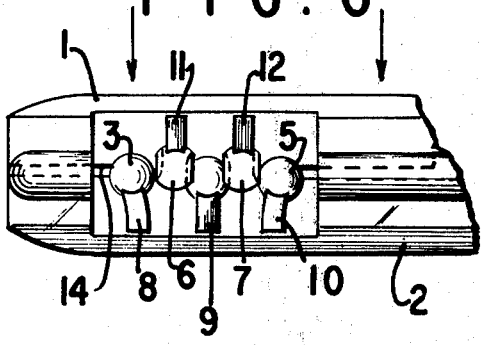
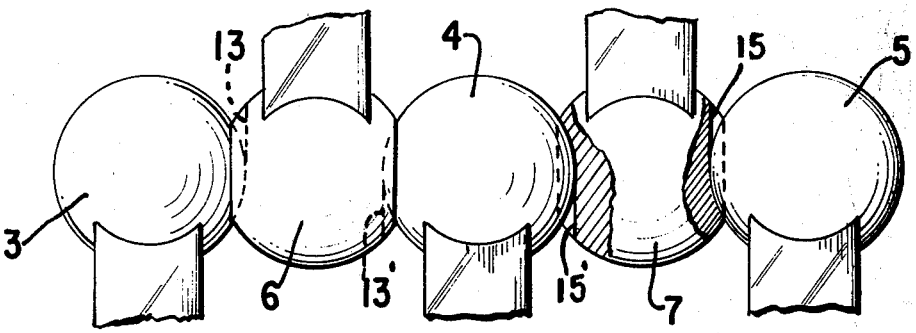
FIG. 7
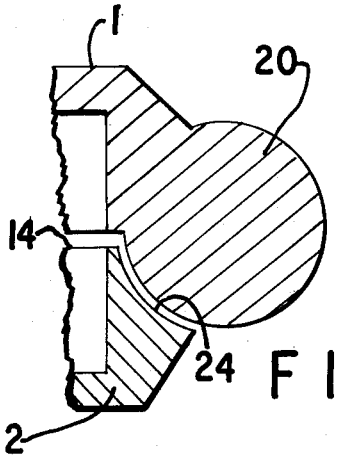
FIG. 8
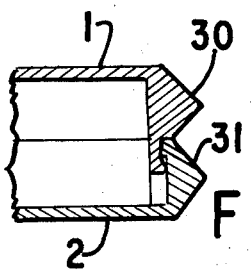
FIG. 9
INVENTOR
ROBERT J. MULLIGAN
BY Harvey W. Stalblich
ATTORNEY

HINGED BOX

This invention relates to hinged boxes made by injection molding of thermoplastic material.

Many different types and kinds of hinged boxes have been designed and are being used in commerce. A particularly desirable type of hinged box is one in which the top and bottom sections of the box are identical so that one mold may be used to form the two sections of the box by injection molding of a thermoplastic material. Examples of such hinged boxes are described and claimed in the U.S. Pat. Nos. of G. H. Hake, 2,570,341 of Oct. 9, 1951, G. Svoboda et al., 3,061,137 of Oct. 30, 1962, and G. Svoboda et al., 3,179,281 of Apr. 20, 1965. As will be noted on examination of the Svoboda et al. patents, for example, the members of the hinge consist of spherical or ball shaped members at the end of studs which protrude from the back of the box and interlock to provide the hinge. In U.S. Pat. No. 3,061,137, each of the two hinges is made up of three ball-like members in which the central ball member is provided with grooves on opposite sides of the ball extending at right angles to each other into which two outwardly extending smaller ball shaped members in transversely aligned relation are received and held in place in the grooves. This hinge requires a low tolerance in the dimensions of the ball members and even when accurately made the hinge is undesirably loose and the cover of the box will not stay in a partially opened position. Also, as will be apparent, if one of the ball members breaks, which is a common occurrence, the hinge will no longer hold together.

An improvement of the Svoboda et al. hinged box of U.S. Pat. No. 3,061,137 is described and claimed in U.S. Pat. No. 3,179,281. In this hinged box the hinge members are made up of four ball-like members in which one of the balls has a pair of continuous grooves extending at right angles to each other on opposite faces and another ball has one groove extending across its face. As in the case of the three-ball hinge of U.S. Pat. No. 3,061,137, low tolerance must be maintained in order for the hinge to hold together and, likewise, if one of the ball members should break off from the back of the box the hinge becomes practically worthless.

In addition to the fact that the three and four member ball hinges of the Svoboda et al. patents provide a loose hinge which is easily damaged, the protruding ball members tend to catch on items which may be in a man's pocket or a woman's purse in which the box may be carried. Also, the protruding balls make the box more difficult to handle in manufacturing and automatic filling operations, and when it is desired that the box be overwrapped with thin paper, foil or plastic wrapping material, the protruding hinges tend to tear through the overwrap.

The new hinge of the present invention minimizes the above-mentioned disadvantages of the prior art hinges. The new hinge of the present invention is stronger, stiffer and the top will stay in position when opened. The hinge will hold together though one of the ball members of it may be broken off. It is also more attractive, can be overwrapped with thin wrapping material and does not tend to catch on other items with which it may come in contact.

More specifically, the construction of the hinged box will be apparent from the drawings, in which:

FIG. 1 is a top plan view of the hinged box in a closed position;

FIG. 2 is a plan view of the box in an open position;

FIG. 3 is an elevational view of the rear of the box taken in the direction of the arrows 3—3 of FIG. 1;

FIG. 4 is a partial plan view of the two sections of the hinged box separated by a short distance;

FIG. 5 is a partial elevational view of the five elements of one of the hinges taken from the rear of the box with the two parts of the box separated;

FIG. 6 is an elevational view of one of the hinges, shown with slight exaggeration, taken from the rear as the two sections of FIG. 5 are being assembled;

FIG. 7 is an enlarged view of the five ball elements which make up one of the hinges of the box after it has been assembled, taken from the rear of the box;

FIG. 8 is an enlarged cross-sectional elevation taken on the line 8—8 of FIG. 3; and FIG. 9 is an enlarged cross-sectional elevation taken on line 9—9 of FIG. 1.

The hinged box of the present invention consists of a top member 1 and a body member 2. When these two members are made on the same mold they will, of course, be identical in all dimensions. If it is desired that a box be made with a thin cover and a deep body, one member of the mold may be deeper than the other so as to provide such a box. Accordingly, with two molds of different depth three different capacity boxes may be made. With three different molds it is possible to make boxes of six different capacities.

When the two identical sections, 1 and 2, are placed back to back with their cavities facing upwardly, the ball-shaped members 3, 4 and 5 are opposite members 6 and 7 as shown in FIG. 4. These ball members may have the same diameters as shown in the drawings, but as will be obvious on consideration of the Svoboda et al. patents, some may be larger than others. In a typically small box suitable for carrying in one's pocket or purse, the balls may be about one-eighth of an inch in diameter, although for larger boxes the diameter may be greater, and for smaller boxes the balls may be smaller.

The balls making up the elements of the hinge are attached to the main body of the box by studs or protrusions, 8, 9, 10, 11 and 12 extending from the rear of each section of the box as shown in FIG. 4. The diameter of the balls and the length and direction of the outwardly extending studs should be such that the center line of the several ball members falls in a plane formed by the edges 14 of the box which meet when the box is closed, as will be evident from FIGS. 5 and 6.

The ball elements 6 and 7 have grooves as shown in the enlarged view of FIG. 7. In a preferred embodiment these grooves are at right angles to the plane formed by the inner edges 14 of the box as shown in FIG. 5. The grooves do not extend all the way across a chord of the ball element as do the grooves in ball members of the Svoboda et al. patents. These grooves, or recesses, may run in the same direction as shown in the drawing or, if desired, the outermost grooves 13 and 15 of balls 6 and 7 may be at right angles to the innermost grooves 13' and 15'. As will be seen from FIG. 7, one of the grooves 13 in ball 6 extends part way across a chord of ball 6 in one direction, whereas the other groove 13' extends part way across the face of the ball but starting in a different direction. Similarly, ball 7 has two grooves, the innermost groove 15' starting from the same position on the ball member 7 as does groove 13' start on ball 6. As will be seen, the ball members 6 and 7 are not deflected when ball member 4 is pressed into the grooves as shown in FIG. 6. Ball members 3, 4 and 5 do not have any grooves. In every instance the grooves 13 and 13' have a semi-circular profile to match the diameter of ball members 3, 4 and 5 and the bottommost section of the groove extends halfway across the ball so that when ball members 3, 4 and 5 are seated all of the ball members are in transverse alignment as shown in FIG. 7.

The two sections of the box are hinged together be pressing the top and bottom sections of the box together as is obvious from FIGS. 5 and 6. The top and bottom sections of the box, regardless of their particular thickness, may be aligned and the two sections pressed together either by hand or by passing the two sections through a roller or similar device. As will be seen in FIG. 6, ball members 3 and 5 are sprung apart a short distance in order to clear the edge of the grooves 13 in ball 6 and the corresponding groove 15 in ball 7 when the two sections of the box are forced together. The elasticity of the thermoplastic resin making up the box permits outwardly extending stud members 8 and 10 to deflect without breaking when ball members 6 and 7 are forced between the three ball members 8, 9 and 10 to provide a hinged structure as shown in enlarged view FIG. 7.

If it is desired that the hinged members be assembled by pressing the two parts of the box together in a different direction than just described, the direction of the grooves in the ball members may be adjusted accordingly. For example, the innermost grooves 13' and 15' may be at right angles to those shown in FIGS. 5 and 6 and the two sections of the box may be assembled by laying the two parts back to back with top and bottom lying on a smooth surface and pressing them together while the box is in a fully opened position.

As will be obvious on consideration of the drawings, if any one of the ball members should break off, the remaining members will continue to function to help provide a relatively stiff hinge which will hold the cover of the box to be opened and stay in place.

The hinges just described are substantially stronger than those of the Svoboda or the Hake patented structures. For example, when the box of the present invention is fully opened it takes 170% more force to pull the hinge apart than in the case of the four-ball Svoboda hinge. When the box is overfilled and strain is placed on the hinges when an effort is made to close the lid, the hinge of the present invention is 200% stronger than the Svoboda hinges.

Although the foregoing structure represents an advance in the art over the three and four-ball hinges of Svoboda, for reasons pointed out above, it may be further improved by the addition of other structural elements not suggested by the structure of prior art hinges.

As will be noted, particularly in FIG. 4, the back of each section of the box may have outwardly extending solid cylindrical members 20 and 22 on one section of the box and 20' and 22' on the other. These members have essentially the same diameter as the ball members mentioned above. The cylindrical members protrude from the back section of the box as shown in FIG. 8, so that the axis of the solid cylindrical members is in transverse alignment with the ball members when the two sections of the box are closed as shown in FIGS. 1, 2 and 3. Also, the back of the box has grooves 24 and 25 which are of the same length as the cylindrical members 20 and 22, respectively. Accordingly, when the two sections of the box are snapped together, the cylindrical member 20 will fit into groove 24' and cylindrical member 22 will fit into groove 25'. FIG. 8 is a cross-sectional view taken on line 8—8 of FIG. 3 showing how the cylindrical members fit into the grooves. The coaction of the cylindrical members closely fitting into the grooves as just described and the interlocking ball members provide a hinge that is exceptionally strong and stable. The back edge of the box is relatively smooth and the hinge members do not tend to catch on objects. The box can be wrapped with thin wrapping material without danger of having the hinge members puncturing it because they protrude from the back of the box.

The structure just described in the preceding paragraph increases the strength, rigidity, and stiffness of the hinge and adds smoothness to its operation. As will be apparent from the drawings, the cylindrical bar-like members which butt together in the center of the box, that is, member 20 engaging member 20', makes the hinge considerably stronger when lateral force is applied to it. Also, as will be apparent, the cylindrical members fitting snugly into the groove, that is, member 20 into groove 24' and member 22 into groove 25', adds strength to the hinge when force is applied in other directions.

The hinged box of the present invention may be provided with a latch, if desired, of any conventional type. However, inasmuch as many of the common latches protrude from the face of the box, the parts of the latch also present a problem of catching on clothes and rupturing thin wrappings that may be applied to the box. Accordingly, the box of the present invention may have means of shielding the latch so that it will not catch on clothes or tear thin wrapping material.

To protect the latch from exposure and also to make it easier to open the hinged box with the fingers, protruding sections 30 and 31 of FIGS. 2 and 9 may be provided on the face of the box which carries the latching means. These two protruding sections are, of course, identical inasmuch as the two parts of the box are likewise identical. FIG. 9 is a cross-section taken along line 9—9 of FIG. 1. As will be seen, the protruding section protects the latching mechanism as well as providing means for easily opening the box with the fingers of one's hand.

Although in the particular design shown in the drawings wherein the protruding section curves outwardly from the ends of the box to a maximum at the center, it will be understood that this outwardly protruding section may run the full length of the box, thus making overwrapping with thin wrapping material easier while at the same time protecting the latch of whatever type may be used and providing an easy grip for the fingers to open the box.

As indicated above, the hinged box of the present invention is preferably made by injection molding of a thermoplastic material. These plastics ordinarily have sufficient resiliency to permit the stud members which terminate in ball members 3 and 5 to be deflected slightly as shown in FIG. 6. Suitable plastics include cellulose acetate, cellulose butyrate, polystyrene, polymethacrylates, polyvinylcarbonates and many other conventionally used plastics which are stiff but not brittle and do have a small degree of resiliency.

I claim:

1. A hinged box having a body section and a cover section with two hinge members each comprising five ball-like elements which terminate on studs extending outwardly from the back sections of the box, the center line of said five ball elements being on a line parallel to the back of the box and in a plane formed by the inner edges of the body section and cover section of the box, a pair of said ball elements of each hinge member protruding from the body section of said box and a pair of said ball elements protruding from the cover section, each ball of each of the two ball element members having two grooves extending only part way across the chord of the ball, the bottommost section of each groove extends halfway across each ball element, the two innermost grooves of each of said two ball elements being parallel and running in the same direction, the grooves on each of the outermost faces of the said two ball elements being parallel to each other but starting across the ball elements from a different direction than do the grooves on the other side of the balls.

2. A hinged box in accordance with claim 1 in which each of the body section and top section have protruding cylindrical bar-like members which are parallel to the back of the box and complementary grooves molded along the back of the box into which the protruding cylindrical bar members may fit in rotatable position, the longitudinal axis of said protruding cylindrical bar members coinciding with the center line of the five ball members protruding from the back of the box.

* * * * *